US006501928B2

(12) United States Patent
Schwarz et al.

(10) Patent No.: US 6,501,928 B2
(45) Date of Patent: Dec. 31, 2002

(54) METHOD AND APPARATUS FOR SETTING A METERING GAP IN A DEVELOPER STATION

(75) Inventors: Heinrich Schwarz, Freising (DE); Joseph Knott, Tutzing (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/824,391

(22) Filed: Apr. 2, 2001

(65) Prior Publication Data

US 2002/0037183 A1 Mar. 28, 2002

(30) Foreign Application Priority Data

Sep. 25, 2000 (DE) ..... 200 16 544

(51) Int. Cl.[7] ..... G03G 15/00
(52) U.S. Cl. ..... 399/126; 118/261; 399/274
(58) Field of Search ..... 399/126, 274, 399/284, 119; 118/261

(56) References Cited

FOREIGN PATENT DOCUMENTS

| | | | |
|---|---|---|---|
| DE | 31 18 995 C2 | | 2/1983 |
| DE | 31 17 296 C2 | | 1/1984 |
| JP | 56-72468 | * | 6/1981 |
| JP | 63-200175 | * | 8/1988 |
| JP | 1-219859 | * | 9/1989 |

* cited by examiner

*Primary Examiner*—Joan Pendegrass
(74) *Attorney, Agent, or Firm*—Schiff Hardin & Waite

(57) ABSTRACT

The invention is directed to a method and to an apparatus for setting a metering gap in a developer station (1). The developer station (1) includes a magnetic drum (5) that comprises a preceding metering device for the acceptance of a developer mix (6) and for forming a uniformly distributed developer mix (6), whereby the metering gap (2) is formed between the magnetic drum (5) and the metering device and the metering device is formed by a metering profile (3). The metering profile (3) is adjustably held such at both axial ends by a respective eccentric (4) that a setting of the width of the metering gap (2) ensues by turning the respective eccentric (4). The eccentrics (4) are adjustable independently of one another.

30 Claims, 4 Drawing Sheets

METHOD AND APPARATUS FOR SETTING A METERING GAP IN A DEVELOPER STATION

BACKGROUND OF THE INVENTION

1. Field of the Invention

The present invention is directed generally to a developer station in an electrographic apparatus, and more specifically to a method and apparatus for setting the toner metering gap therein.

2. Description of the Related Art

In traditional developer stations, for example according to German Patent document DE 31 17 296 C2, what is referred to as a leveling ledge is provided in the form of a rotatable shaft that is halved in regions (see FIG. 1 therein, reference character 42), so that the turning of the leveling ledge enables a setting of the width of a spacing between the leveling ledge and a neighboring developer drum (the hollow cylinder 24 therein). The spacing is varied by turning the leveling ledge and, accordingly, the amount of developer that is applied onto the surface of the developer drum is set.

According to German Patent Document DE 31 18 995 C2, a specific distance is provided between a developer drum and a stripper drum and this, for example, should be adjustable by seating the stripper drum in eccentric bushes. The distance of the stripper drum from the developer drum determines the height of the developer mix from the developer drum. However, the stripper drum constantly rotates with the developer drum.

In the first-cited patent, German Patent document DE 31 17 296 C2, the leveling ledge is constantly rotatable and, thus, adjustable only over the full axial extent. The change of the rotational position of the leveling ledge is constant over the entire axial length.

In the second patent, German Patent Document DE 31 18 995 C2, the stripper drum is fashioned as a constantly rotating shaft, so that a variation of the rotational position in the eccentric bushes here also leads to a change in width of the gap that is constant over the entire axial length of the stripper drum.

SUMMARY OF THE INVENTION

Compared to the foregoing, an object of the present invention is to provide a method and an apparatus for setting a metering gap in a developer station whereby the metering gap, as viewed over its axial length, has an adjustable width such that tolerance fluctuations can be compensated.

For achieving this object, the present invention provides an apparatus for setting a metering gap in a developer station, wherein the developer station includes a magnetic drum that has a preceding metering device for the acceptance of a developer mix and for forming a uniformly distributed developer mix, wherein the metering gap is formed between the magnetic drum and the metering device and the metering device is formed by a metering profile, where the metering profile is adjustably held at both axial ends by a respective eccentric such that a setting of the width of the metering gap ensues by turning the respective eccentric, and wherein the eccentrics are adjustable independently of one another.

In further developments, the eccentric is pressed in a housing of the developer station. The eccentric may be pressed in the metering profile. As a preferred embodiment, an application section for a tool is provided at the eccentric so that the eccentric can be turned with the tool. Preferably, the eccentric pitch is formed such that a precision of the width adjustment of the metering gap of approximately 0.02 mm is enabled. A pointer may be provided at each eccentric, this indicating the position of the eccentric with a scale fixed to the housing. As a feature of the invention, an original factory setting of the eccentric is marked on the scale.

In one arrangement, the present developer station includes the magnetic drum with the photoconductor drum arranged following it. A delivery device for the developer mix may be arranged preceding the magnetic drum. A rubber cord that forms a seal is preferably respectively arranged between the two lateral parts of the developer station and the profiles arranged therebetween. These profiles may be fashioned as extruded profiles. In one embodiment, the rubber cord is arranged in a channel that is formed at the lateral part of the developer station. The channel may be of a rectangular crossection. For example, the width of the channel may be smaller than the diameter of the rubber cord and/or that the depth of the channel amounts to at least 50% of the diameter of the rubber cord. A preferred embodiment has the width of the channel amounting to about 90% of the diameter of the rubber cord and/or that the depth of the channel amounts to about 70% of the diameter of the rubber cord. In one example, the width of the channel amounts to about 1.1 mm and/or that the depth of the channel amounts to about 0.8 mm, whereby the diameter of the rubber cord amounts to about 1.2 mm. The rubber cord includes a core of at least one rubber string and an envelope of a textile fabric, for example. The rubber cord is composed of an elastoid and/or that the textile fabric is composed of a polyester weave. The rubber cord is of a round crossection in its unstressed condition.

The present invention also provides a method for setting a metering gap in a developer station, wherein the developer station includes a magnetic drum that has a preceding metering device for the acceptance of a developer mix and for forming a uniformly distributed developer mix, the metering gap being formed between the magnetic drum and the metering device and the metering device being formed by a metering profile, the metering profile being adjustably held at both axial ends by a respective eccentric, and the eccentrics being adjustable independently of one another, in that a setting of the width of the metering gap ensues by turning one of the eccentrics.

As a further aspect of the method, the first eccentric is set independently of the second eccentric. The metering gap may be tilted such that it is diminished in a first region that lies closer to one of the eccentrics and is enlarged in a second region that lies farther away from this eccentric. The width adjustment of the metering gap preferably ensues with a precision of 0.02 mm. The setting of the eccentric can be implemented with the assistance of a pointer connected to the eccentric such that the pointer is set to a mark identifying an original setting. Further, the eccentric may be adjusted with a tool via an application section.

In further detail, according to a first aspect of the invention, a magnetic drum is provided for setting a metering gap in a developer station, the magnetic drum interacting with a preceding metering device for picking up a developer mix and for forming a uniformly distributed developer mix. The metering gap is formed between the magnetic drum and the metering device. The metering device is formed by a metering profile, so that the metering profile is adjustably fixed at both axial ends by a respective eccentric such that a setting of the width of the metering gap ensues by turning the eccentrics, whereby the eccentrics are adjustable independently of one another.

As a result of the eccentric provided at both sides, a tolerance compensation can ensue with respect to the relative position of the adjustable component part (the metering profile here) relative to the stationary component part (magnetic drum here). This tolerance compensation, in particular, ensues according to the inventively provided method.

The metering profile employed according to one embodiment of the present invention can exhibit specific manufacturing tolerances in and of itself that could lead to an imprecise metering gap. These manufacturing tolerances can be compensated by the adjustment of the eccentrics at both sides.

The inventively proposed, variable setting of the metering gap also enables a greater flexibility given different toners and developers. Each toner and each developer requires a different metering gap dimension. When the apparatus, i.e. the developer station, is to be switched to a different toner, for example because the user requests this, then the metering gap can be adapted on site.

The height of the metering gap can be reset, particularly during the course of service work at the developer station. A diminution of the metering gap in at least regions thereof and/or an enlargement of the metering gap in at least regions thereof can thereby ensue dependent on the wear or misadjustment of the developer station components or dependent on the toner to be processed. In particular, a tilting of the gap can ensue to the effect that the gap is made smaller in a first region that lies closer to one of the eccentrics and is enlarged in a second region that lies farther away from this eccentric.

It has proven especially advantageous when the eccentric, on the other hand, is pressed into the housing of the developer station as well as, on the other hand, the eccentric is also pressed into the metering profile. An unintended release of the eccentric is thereby precluded.

An adjustment of the eccentric that is realized by an application section for a tool can ensue with the tool, for example a spanner wrench.

The eccentric pitch is preferably fashioned to be ascending so slightly that a precision of the width setting of the metering gap of approximately 0.02 mm is possible.

A pointer can preferably be provided at each eccentric that indicates the position of the eccentric relative to a scale fixed to the housing, and in one embodiment an original setting of the eccentric undertaken at the factory is marked on the scale.

The developer station that includes the present inventive mechanism is realized having a magnetic drum that is followed by a photoconductor drum; a delivery device for the developer mix also precedes it.

In order to seal joints between lateral parts at the developer station and profiles lying or, respectively, arranged therebetween, a seal is provided according to a second aspect of the invention, which can also be viewed as being independent of the first aspect of the invention (which is the eccentric bearing of the metering profile).

Given traditional seals, silicone strips were applied from the outside after the assembly of the developer station; these, however, are very time-consuming to apply and convey an optically unclean impression. Moreover, this seal was not capable of being fashioned 100% tight at sections that are difficult to access. Sealing parts that are movable relative to one another was not possible at all.

In a preferred exemplary embodiment of the second aspect, the present invention respectively provides a rubber cord, which forms a seal, between the two lateral parts of the developer station and the profiles (movable and non-movable) arranged therebetween. As a result thereof the movable parts or, respectively, profiles, such as the metering profile, can also be provided with a seal, the quality of the seal is noticeably improved compared to known developer stations. The profiles are preferably fashioned as extruded profiles.

In particular, the rubber cord is arranged in a channel that is fashioned at the lateral part of the developer station. This channel preferably comprises a rectangular crossection, whereby the width of the channel is less than the diameter of the rubber cord and/or whereby the depth of the channel amounts to at least 50% of the diameter of the rubber cord.

It is especially advantageous when the width of the channel amounts to about 90% of the diameter of the rubber cord and/or that the depth of the channel amounts to about 70% of the diameter of the rubber cord.

Recited numerically, the width of the channel is preferably 1.1 mm, the depth of the channel preferably 0.8 mm and the diameter of the rubber cord is preferably 1.2 mm.

The rubber cord is composed of a core made of at least one rubber string and of an envelope made of a textile fabric, whereby the rubber string is composed of an elastoid and/or that the textile fabric is composed of a polyester weave.

The rubber cord preferably comprises a round crossection in its unstressed condition.

BRIEF DESCRIPTION OF THE DRAWINGS

The above object, the features and advantages of the present invention can be understood better taking the following, detailed description of the preferred embodiments of the invention into consideration and with reference to the appertaining drawings.

FIG. 3 is a magnified detail view of the seal that is introduced into a channel;

DETAILED DESCRIPTION OF THE PREFERRED EMBODIMENTS

Printers and copiers print images on a recording media, such as paper, by forming a charge image on a photoconductor that may be a drum or web, developing the charge image by application of toner, and transferring the toner from the photoconductor drum to the recording media. The toner, also referred to as a developer mix, is supplied to the photoconductor in a developer station.

Figure 1:
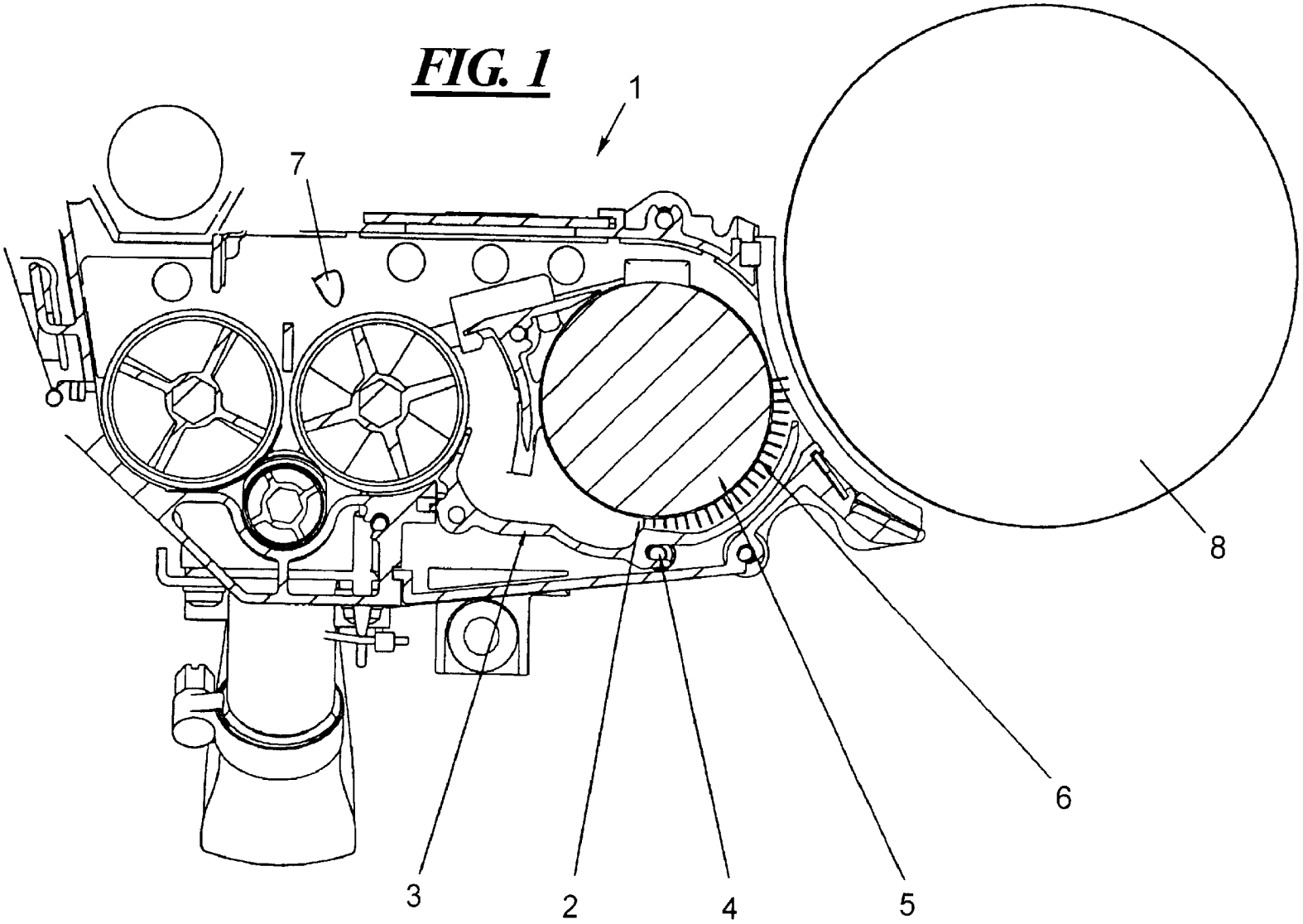
FIG. 1 is a side view of the developer station of a printer or copier according to the principles of the present invention.

FIG. 1 shows a portion of a developer station 1 of an electrographic printer device in a side view. A delivery device 7 for a developer mix 6 that is applied in a specific height on a magnetic drum 5 with a metering profile 3 is situated in the left part of the developer station 1. The developer mix 6 is transported farther by the magnetic drum 5, and the toner therein is delivered to a photoconductor drum 8.

The height of a metering gap 2 that is formed between the metering profile 3 and the magnetic drum 5 is set via the metering profile 3.

The metering gap 2 serves the purpose of fine-tuning the mix quantity of the developer mix 6 that is transported into the development region by the magnetic drum 5. The mix quantity transported per time unit is an important criterion for the print quality. The mix quantity must be very exactly adapted given different toner and developer types. This occurs via the metering gap 2. Too thin or too thick a mix carpet on the magnetic drum 5 leads to losses in print quality. The metering gap 2 can be exactly adjusted with the present invention, so that an optimum height of the developer mix 6 can be achieved.

To this end, the position of the metering profile 3 is set via two eccentrics 4 that are arranged at the axial end sections of the metering profile 3. This setting can be performed on site as needed, for example by a service technician.

Figure 6:
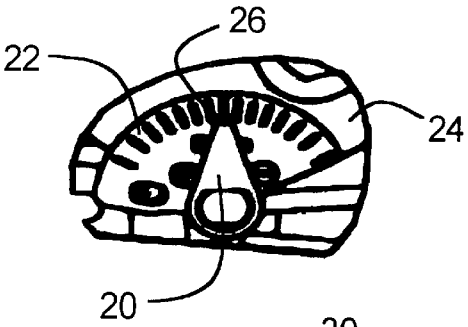
FIG. 6 is an enlarged side view of a scale and pointer from FIG. 5.

Since every eccentric 4 has a pointer 20 (see FIG. 6) that indicates the relative position of the eccentric 4 via a scale 22 fixed to the housing 24 and the original factory setting 26 is marked on this scale 22, this original setting can be reproduced at any time.

Figure 5:
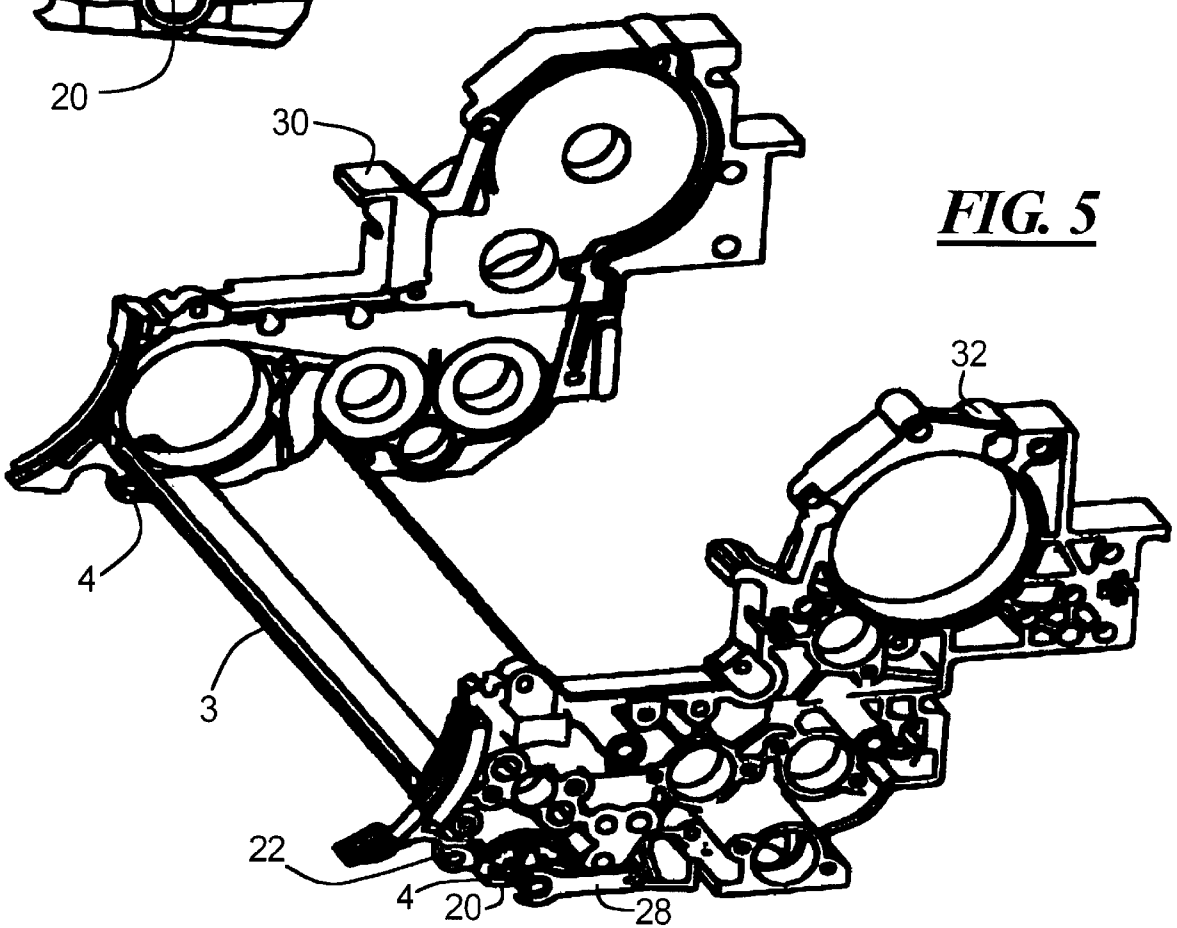
FIG. 5 is a perspective view of a profile with an eccentric at each end and held between two lateral parts.

The eccentrics 4 are fashioned as discoids and are pressed into the lateral parts 30 and 32 (FIG. 5) of the housing of the developer station 1, so that an unintentional release or a loss of adjustment over time is precluded. The eccentric 4 can be turned with a tool 28 (see FIG. 5), preferably with a spanner wrench.

The eccentric 4 is also pressed into the metering profile 3 in order to guarantee absolute freedom from play. The freedom from play between these two component parts is the prerequisite for a reproducible setting of the metering gap 2. The eccentric 4 is provided with a very slowly ascending pitch, so that precisions of about 0.02 mm in the width at the metering gap 2 can be achieved.

The current setting of the eccentric 4 can be read from the scale 22.

As viewed in the axial direction, a respective eccentric 3 engages at both sides, or ends, of the metering profile 3, whereby the setting of the two eccentrics 4 ensues independently of one another. As a result thereof, different tolerances that perhaps occur over the extent of the metering profile 3 can be compensated. A region-by-region variation of the size of the metering gap can ensue as a result of the independent setting possibility of the eccentrics 4. In particular, a tilting of the metering profile 3 and, thus, of the metering gap 2 as well can thereby ensue to the effect that the metering gap 2 is diminished in a first region that lies closer to one of the eccentrics 4 and is enlarged in a second region that lies farther away from this eccentric 4.

As a result of the independent setting possibility of the two eccentrics 4, manufacture in the factory is also simplified and the original positions can be more simply and precisely undertaken.

FIG. 1 shows the cross-section of the metering profile 3. The geometry is selected such that a self-cleaning effect occurs when an adjustment of the metering profile 3 is undertaken. However, it must thereby be assured that no toner accumulation proceeds onto the photoconductor drum 8 after the adjustment of the metering profile 3.

The adjustment possibility of the metering profile 3 in a direction A for the exact adjustment of the metering gap 2 enables a high flexibility, so that the greatest variety of toners and developers can be utilized. The metering gap 2 is individually set for each toner or developer.

When, for example, the toner is changed, then the metering gap 2 can be readjusted on site given a service job without having to return the entire developer station 1 to the manufacturer's factory.

It is assured during long-term operation that the toner metering can be maintained with high precision, so that a uniform inking of gray scale images can thereby be achieved. Even if the metering gap were to become misadjusted during the course of the apparatus use, for example diverging from the original setting, it can again be set correctly by readjustment at any time.

In particular, the sheet-shaped fashioning of the metering profile 3 enables an optimum dust protection. In order to keep this dust protection in force, even given an adjustable or, respectively, movable metering profile 3, the invention provides a seal that can be seen well in FIG. 2.

In order to seal the developer station 1 so as to be toner dust-tight in a simple and cost-beneficial way, the irregularities and the play relative to, for example, movable profiles such as the metering profile 3 are sealed with a seal. The seal is fashioned as a rubber cord 11 whose crossection can be seen in FIG. 3. This rubber cord 11 is placed into a channel 12 between the lateral parts 30 and 32 and the profiles 3 and 13. When the lateral parts 30 and 32 are screwed down, the rubber cord 11 is compressed in the channel 12 and thereby produces the sealing function between the lateral part and the profiles 3 and 13.

Figure 4:
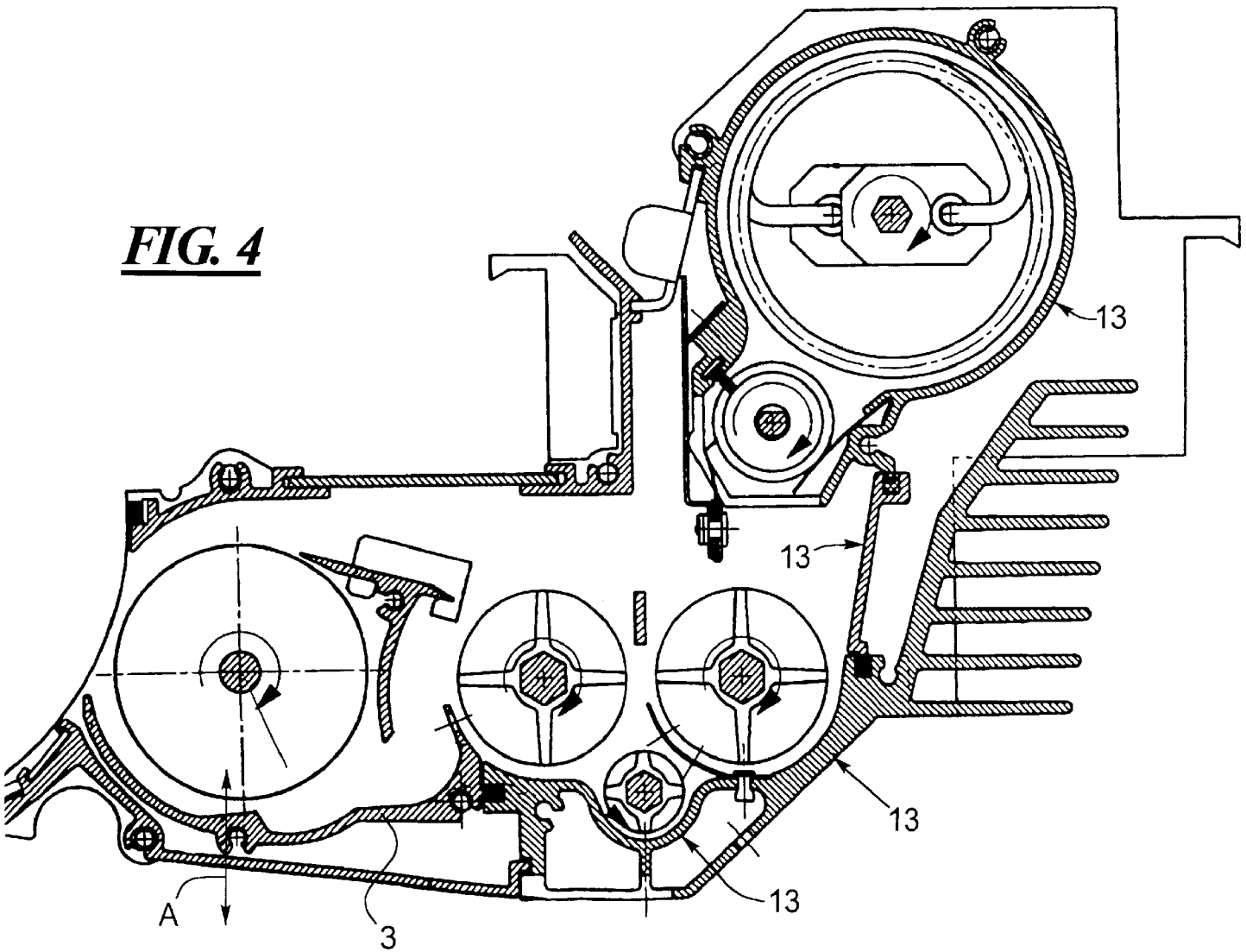
FIG. 4 is a side view of the developer station wherein the position and arrangement of extruded profiles is shown.

The end faces of the profiles 3 and 13 press against the seal. The profile 3 is the movable or, respectively, externally adjustable metering profile 3 as well as the profiles 13 (see FIG. 4) which are stationary. The profiles 3 and 13 are fashioned as extruded profiles for cost reasons.

The rubber cord 11 (or gasket) is composed of an inwardly disposed rubber string 9 that is surrounded by a textile fabric 10. The rubber cord 11 has a round crossection and is placed into a preferably rectangular channel 12.

The channel is geometrically designed such that the rubber cord 11 seizes slightly after being introduced. To that end, the channel width is fashioned somewhat smaller than the diameter of the rubber cord 11. The channel depth should amount to at least half the diameter of the rubber cord 11.

The rubber cord 11 can be composed of one rubber string 9 or of a plurality (not shown) of rubber strings that are constructed of an elastoid. The textile fabric 10 is composed of a polyester weave. The textile fabric 10 envelopes the rubber string 9.

The rubber string 9 is preferably composed of 50% elastomer and 50% paliamide.

For example, the diameter of the rubber cord amounts to 1.2 mm, the width of the channel to 1.1 mm, and the depth of the channel amounts to 0.8 mm.

Figure 2:
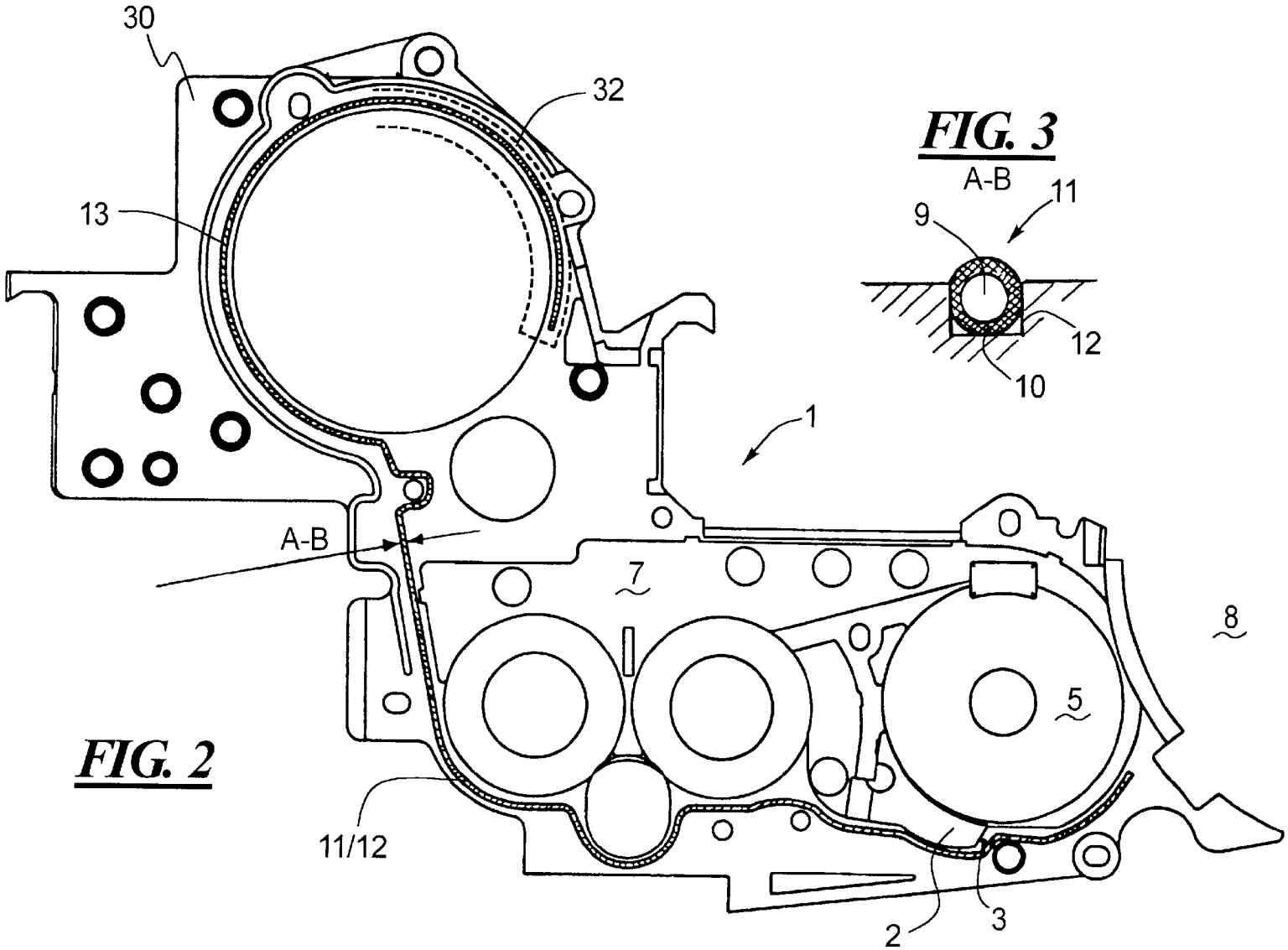
FIG. 2 is another side view of the developer station, whereby the position of a seal is illustrated.

The sealing function is effected by pressing the lateral parts 30, as shown in FIG. 2, of the developer station 1 against the end faces of the profiles 3 and 13, whereby the rubber cord 11 is compressed. It is advantageous when the rectangular channel 12 has the same or a slightly smaller cross sectional area when compared to the rubber cord 11.

Both fixed 13 as well as movable profiles 3 can be sealed relative to the lateral parts (side panels) with this arrangement. For reasons of functionality (mobility, tightness), the movable profiles 3 should be fashioned somewhat shorter as viewed in an axial direction than the fixed profiles 13 for this purpose. This measure (the shortening) preferably amounts to 0.2 through 0.5 mm.

As a result of the elasticity of the rubber cord 1, the profiles 3, 13 are automatically centered between the lateral parts 30 and 32 and sealed.

The externally adjustable metering gap 2 can be realized with the metering profile 3 as a result of the present seal. The print quality, as already pointed out above, can be device-specifically optimized with the adjustable metering gap 2, and the developer station 1 can be adapted to different tone and developer types.

This type of rubber cord seal is not linked to shape and can thus be adapted to any sealing contour. The seal can be mounted in the channel 12 simply and self-seizing.

Tests have shown that the inventive seal has good glide properties and acts in self-centering fashion at the movable profiles 3, these being installed with some play between the lateral parts of the developer station 1.

The rubber cord 11 that is utilized has very good wear and abrasion resistance and is resistant to the toner respective developer.

The thin-wall profiles 13 (see FIG. 4) can be dependably sealed with the inventive rubber cord 11 without having the seal element project laterally in and of itself, as would be the case given, for example, a seal of expanded cellular material.

As a result of the good glide properties and the shape stability of the rubber cord 11, the setting range is very large and, in particular, larger than given a mere rubber seal.

It must be emphasized that the profile 3/13 to be sealed need not completely cover the rubber cord 11, a coverage of approximately 50% suffices in order to create the sealing function.

The fabric surface of the textile fabric 10 adapts to the irregularities of the parts to be sealed and thereby improves the sealing action.

Moreover, the claims and the drawings are expressly referenced in view of features of the invention that are not explained in greater detail above.

Although other modifications and changes may be suggested by those skilled in the art, it is the intention of the inventors to embody within the patent warranted hereon all changes and modifications as reasonably and properly come within the scope of their contribution to the art.

We claim:

1. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile; and an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another.

2. A developer station according to claim 1, further comprising:

a housing of the developer station.

3. A developer station according to claim 1, further comprising:

a photoconductor drum arranged following said magnetic drum in a developer mix flow direction.

4. A developer station according to claim 1, further comprising:

a delivery device for the developer mix arranged preceding said magnetic drum in a developer mix flow direction.

5. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile;

an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another; and a housing of the developer station, wherein said eccentrics are pressed in said housing.

6. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile; and an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another, wherein said eccentrics are pressed in said metering profile.

7. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile; and an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another wherein said eccentrics include a tool accepting portion so that said eccentrics can be turned with a tool.

8. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile; and an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another wherein said eccentrics have a pitch that is formed such that a precision of a width adjustment of the metering gap of approximately 0.02 mm is enabled.

9. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile;

an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another; and a pointer at each of said eccentrics and a scale fixed to said housing so that a position of said pointer relative to said scale indicates a position of said eccentrics.

10. A developer station according to claim 9, further comprising:

a mark on said scale showing an original factory setting of a respective one of said eccentrics.

11. A developer station for an electrographic printer or copier, comprising:

a magnetic drum operable to accept a developer mix;

a metering device spaced by a metering gap from said magnetic drum to define said metering gap between said magnetic drum and said metering device, said metering device accepting the developer mix and being operable to form a uniformly distributed developer mix on said magnetic drum, said metering device being formed by a metering profile;

an apparatus for setting the metering gap in the developer station, said apparatus including an eccentric at each axial end of said metering profile to adjustably mount said metering profile at both axial ends such that a change of a width of the metering gap ensues by turning said respective eccentric, and said eccentrics being adjustable independently of one another two lateral parts of said developer station on opposite axial ends of said metering profile so that said metering profile is between said two lateral parts; and a rubber cord that forms a seal disposed between said two lateral parts of the developer station and the profiles arranged therebetween.

12. A developer station according to claim 11, wherein said metering profiles are fashioned as extruded profiles.

13. A developer station according to claim 11, wherein said rubber cord is arranged in a channel that is formed at the lateral part of the developer station.

14. A developer station according to claim 13, wherein the channel comprises a rectangular crossection.

15. A developer station as claimed in claim 14, wherein said channel is of a depth of at least 50% of the diameter of the rubber cord.

16. A developer station according to claim 14, wherein said channel is of a width of the channel amounts to about 90% of the diameter of the rubber cord.

17. A developer station as claimed in claim 14, wherein a depth of the channel amounts to about 70% of the diameter of the rubber cord.

18. A developer station according to claim 14, wherein a width of the channel amounts to about 1.1 mm.

19. A developer station as claimed in claim 14, wherein a depth of the channel amounts to about 0.8 mm and a diameter of the rubber cord amounts to about 1.2 mm.

20. A developer station according to claim 13, wherein the channel is of a width that is smaller than a diameter of the rubber cord.

21. A developer station according to claim 13, wherein the rubber cord comprises a core of at least one rubber string and an envelope of a textile fabric.

22. A developer station according to claim 21, wherein the rubber cord is of an elastoid.

23. A developer station according to claim 21, wherein the textile fabric is of a polyester weave.

24. A developer station according to claim 13, wherein the rubber cord is of a round cross section in its unstressed condition.

25. A method for setting a metering gap in a developer station, comprising the steps of:

providing a developer station that includes a magnetic drum that comprises a preceding metering device for acceptance of a developer mix and for forming a uniformly distributed developer mix, forming a metering gap between the magnetic drum and the metering device, said metering device being formed by a metering profile, providing adjustability of the metering profile at both axial ends by a respective eccentric, and the eccentrics are adjustable independently of one another, and setting of a width of the metering gap ensues by turning one of the eccentrics.

26. A method according to claim 25, wherein a first eccentric is set independently of a second eccentric.

27. A method according to claim 25, wherein the metering gap is tilted such that it is diminished in a first region that lies closer to one of the eccentrics and is enlarged in a second region that lies farther away from this eccentric.

28. A method for setting a metering gap in a developer station, comprising the steps of:

providing a developer station that includes a magnetic drum that comprises a preceding metering device for acceptance of a developer mix and for forming a uniformly distributed developer mix, forming a metering gap between the magnetic drum and the metering device, said metering device being formed by a metering profile, providing adjustability of the metering profile at both axial ends by a respective eccentric, and the eccentrics are adjustable independently of one another, and setting of a width of the metering gap ensues by turning one of the eccentrics wherein the width adjustment of the metering gap ensues with a precision of 0.02 mm.

29. A method for setting a metering gap in a developer station, comprising the steps of:

providing a developer station that includes a magnetic drum that comprises a preceding metering device for acceptance of a developer mix and for forming a uniformly distributed developer mix, forming a metering gap between the magnetic drum and the metering device, said metering device being formed by a metering profile, providing adjustability of the metering profile at both axial ends by a respective eccentric, and the eccentrics are adjustable independently of one another, and setting of a width of the metering gap ensues by turning one of the eccentrics wherein the setting of the eccentric is implemented such with the assistance of a pointer connected to the eccentric that the pointer is set to a marking identifying an original setting.

30. A method for setting a metering gap in a developer station, comprising the steps of:

providing a developer station that includes a magnetic drum that comprises a preceding metering device for acceptance of a developer mix and for forming a uniformly distributed developer mix, forming a metering gap between the magnetic drum and the metering device, said metering device being formed by a metering profile, providing adjustability of the metering profile at both axial ends by a respective eccentric, and the eccentrics are adjustable independently of one another, and setting of a width of the metering gap ensues by turning one of the eccentrics wherein the eccentric is adjusted with a tool via an application section.

* * * * *